US005364043A

United States Patent [19]

Linderoth

[11] Patent Number: 5,364,043

[45] Date of Patent: Nov. 15, 1994

[54] ARRANGEMENT IN A COIL WINDING MACHINE FOR A CABLE OR A SIMILAR STRANDLIKE PRODUCT

[75] Inventor: Gustaf Linderoth, Enköping, Sweden

[73] Assignee: Nokia-Maillefer Oy, Vantaa, Finland

[21] Appl. No.: 949,254

[22] PCT Filed: Jun. 13, 1991

[86] PCT No.: PCT/FI91/00188

§ 371 Date: Nov. 23, 1992

§ 102(e) Date: Nov. 23, 1992

[87] PCT Pub. No.: WO91/19664

PCT Pub. Date: Dec. 26, 1991

[30] Foreign Application Priority Data

Jun. 15, 1990 [SE] Sweden ..... 9002141-1

[51] Int. Cl.[5] ..... B65H 75/34

[52] U.S. Cl. ..... 242/397; 242/158 R; 242/399.1

[58] Field of Search ..... 242/54 R, 158 R, 158.4, 242/DIG. 2

[56] References Cited

U.S. PATENT DOCUMENTS 3,687,385 8/1972 Skalleberg ..... 242/54 R
4,022,391 5/1977 Stein et al. ..... 242/158 R X
4,143,834 3/1979 Hara et al. ..... 242/158 R
4,150,801 4/1979 Ikegami et al. ..... 242/158 R
4,244,539 1/1981 Taneda et al. ..... 242/158 R
4,592,521 6/1986 Hallikas et al. ..... 242/158 R
4,685,631 8/1987 Kurtz et al. ..... 242/158 R X

*Primary Examiner*—Daniel P. Stodola
*Assistant Examiner*—Eileen A. Dunn
*Attorney, Agent, or Firm*—Nixon & Vanderhye

[57] ABSTRACT

Apparatus in a coil winding machine for winding a cable on a reel provided with flanges, comprises a support stand for the reel and a guide for supplying the cable to the reel, a distribution machinery for displacing the support stand and the guide in relation to each other, detectors for detecting the reel flanges and for reversing the distribution machinery, when a cable mm contacts a reel flange, and a measuring device for detecting the thickness of the cable and controlling the distribution machinery in accordance with the thickness measurement of the measuring device. In order to easily take into account the thickness variations of the cable, the detectors are arranged to be mechanically displaced each by a measuring device in accordance with the thickness measurement of the measuring device.

8 Claims, 3 Drawing Sheets

FIG. 1
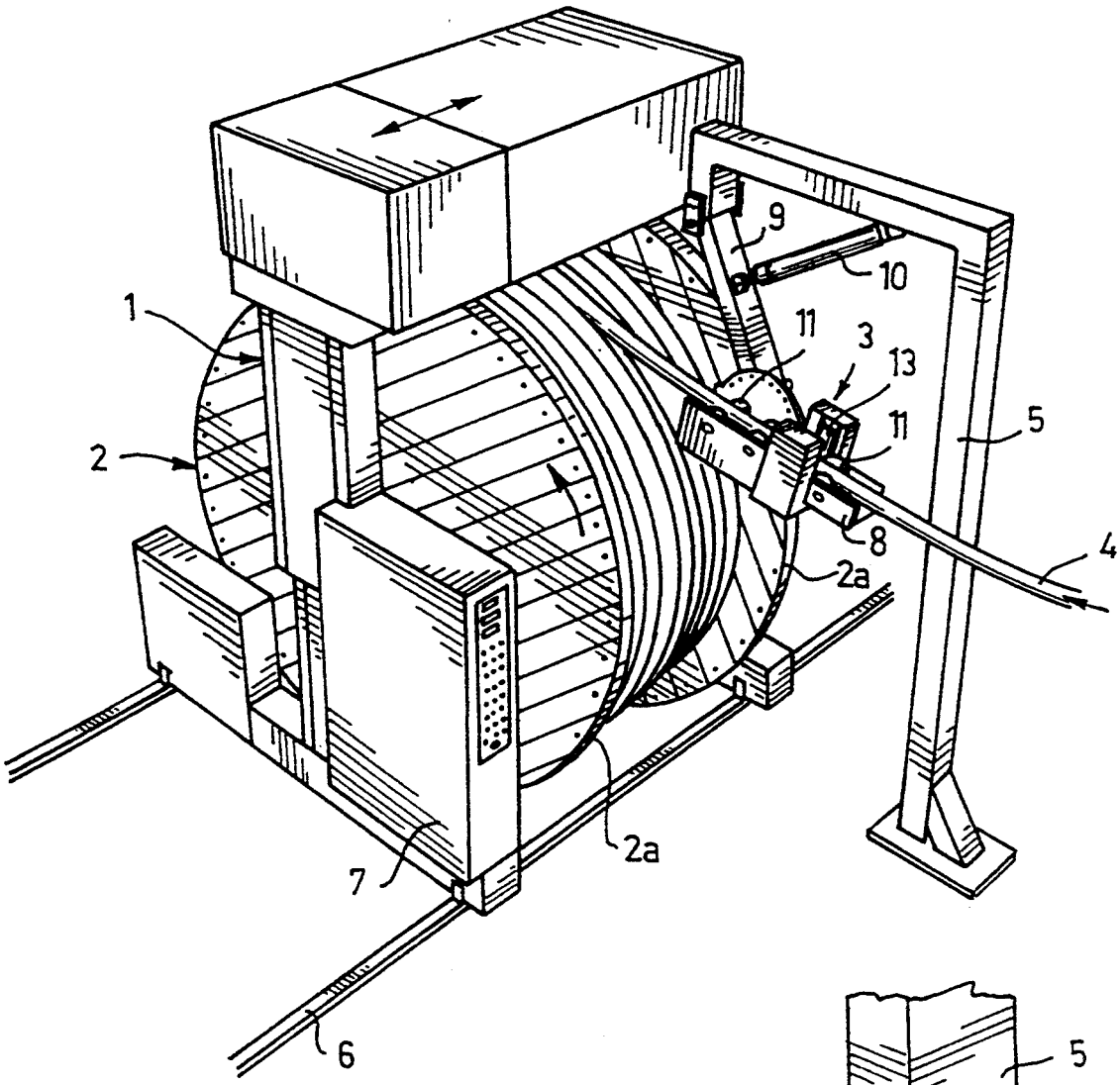
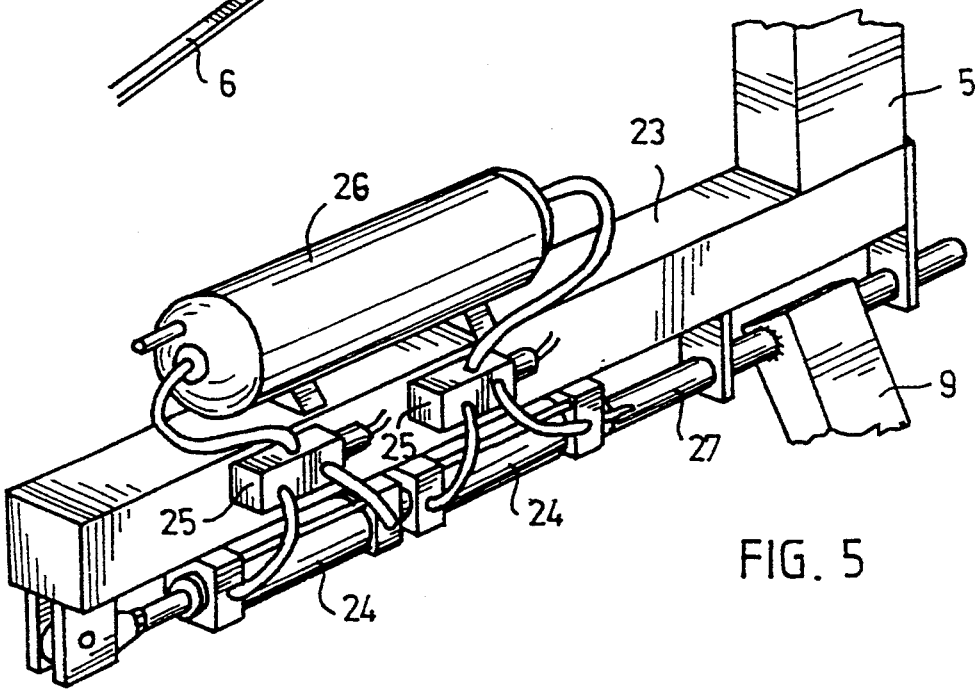
FIG. 5

FIG. 2
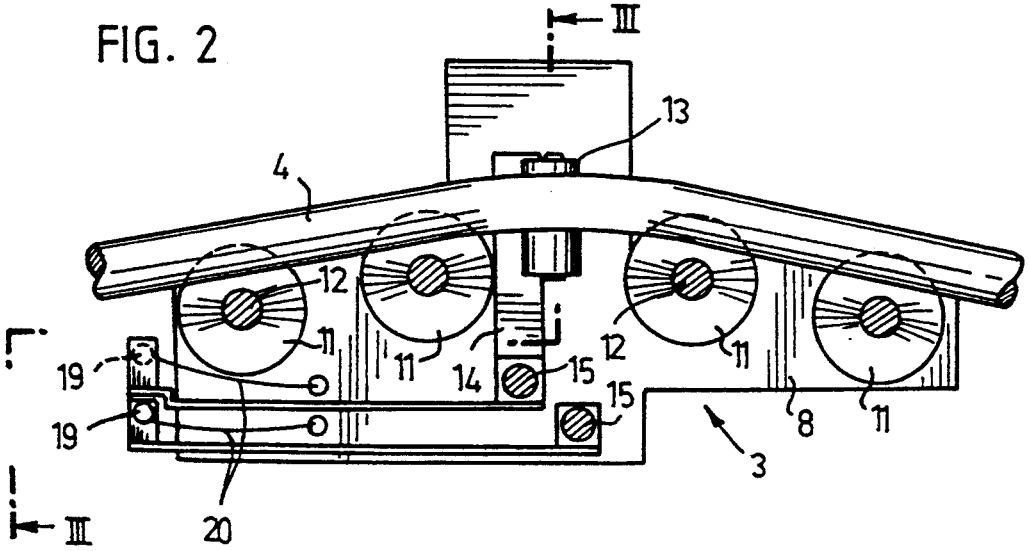
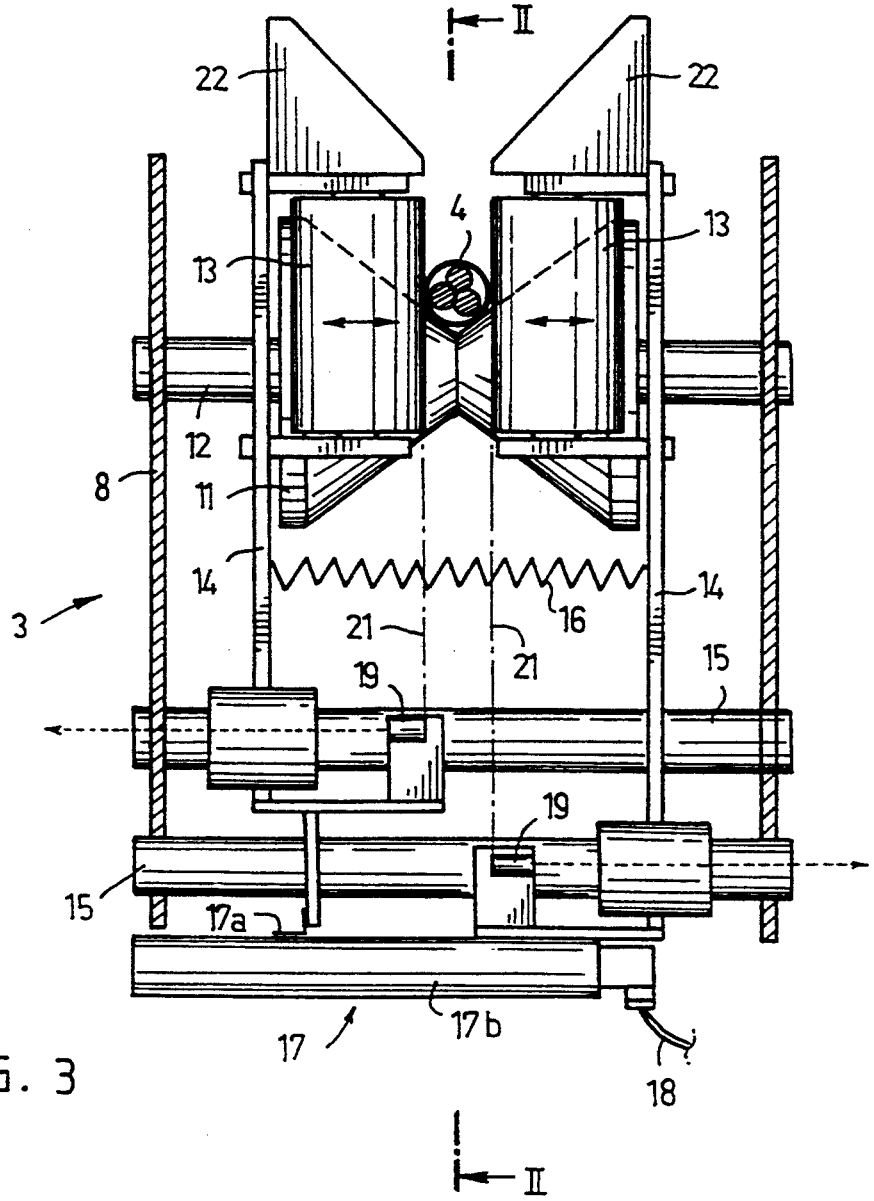
FIG. 3

ARRANGEMENT IN A COIL WINDING MACHINE FOR A CABLE OR A SIMILAR STRANDLIKE PRODUCT

BACKGROUND OF THE INVENTION

The present invention relates to an arrangement in a coil winding machine for winding a strandlike product, such as a cable, on a reel provided with flanges, which coil winding machine comprises a support stand for supporting a reel rotatably around the axis thereof, a guide for supplying the strandlike product to be wound to the reel in order to form superimposed layers of product turns wound adjacent to each other between the flanges of the reel, a distribution machinery for displacing the support stand and the guide in relation to each other by a pitch corresponding to the thickness of the product per product turn, detectors for detecting the reel flanges and for acting on the distribution machinery so that displacement direction between the reel and the guide is reversed, as a coil product turn contacts a reel flange, and measuring means for continuously detecting the thickness of the coil product which measuring means are connected to control the distribution machinery so that the pitch of the product turns on the reel is varied in accordance with the thickness measurement of the measuring means.

The expression "strandlike product" is in this connection intended to include all kinds of narrow endless objects, such as cables, wires, hoses and the like, which can be wound on a reel, mainly products found in the manufacture of electric cables and information transmission wires. In the following the invention will, however, for the sake of simplicity, be described in connection with a cable.

When a cable is wound on a reel or a drum, a guiding means is used to guide the cable to be situated between the flanges of the reel in layers positioned on top of each other, each layer consisting of a number of adjacent cable turns.

In most known coil winding machines, eg U.S. Pat. Nos. 4,143,834 (FURUKAWA), 4,150,801 (KOBE STEEL) and 3,997,128 (FURUKAWA), the winding movements are carried out by an axial displacement of a cable guide and the reel in relation to each other in the axial direction of the reel so that when the reel has rotated one turn, the guide or the reel has moved over a distance corresponding to the thickness of the cable. Known coil winding machines are normally adjustable for handling of reels having different drum diameters and different distances between the flanges. The machines are also provided with a distribution machinery, by which the axial displacement between the guide and the reel per each coil turn, ie the pitch by which the cable is wound on the reel, can be adjusted in each case to correspond with the thickness of the cable to be wound.

A considerable drawback of these known coil winding machines is that the machine operator, when initiating the winding, has to manually adjust the distribution machinery so that the pitch of the cable corresponds to the cable thickness in question. After this the cable is wound by the guide on the reel by a constant pitch from flange to flange. If the thickness of the cable, eg due to an incorrect measurement, does not exactly correspond to the adjusted pitch, or if the cable thickness varies over certain cable lengths from the measured value so that undesired spaces are formed between the cable turns, this may substantially disturb the winding process and impair the winding result.

A further disadvantage is that the machine operator, when initiating the winding, has to manually adjust the turning points for the reversal of the distribution machinery at the reel flanges so that the turning positions correspond to the width or flange thickness of the reel in question. The adjusting of the turning points is usually effected by the operator by moving mechanical limit switches or similar detectors of another type. Besides this being time-consuming, the adjusting often turns out wrong even if the displacement is carried out to a corresponding marking on a graded scale. This is due to the fact that the width and the flange thickness of the reels are not always constant among reels of the same size and type. In particular wooden reels have a tendency to open up and increase in width to a different degree, because the axial tension bars of the reel have yielded. The machine operator must therefore watch every turning point when the cable reaches the inside of the reel flange, and furthermore often intervene so that the turning point does not get too misplaced and result in spoiling of the winding process. It is namely important for the achievement of a closely and optimally filled reel that a good filling is achieved at the flange during the winding of the cable, in order to prevent subsequent cable layers from falling down into possible spaces between the cable and the reel flange in an underlying cable layer.

The U.S. Pat. No. 4244539 refers to a more advanced coil winding machine, in which a measurement of the thickness variations of the cable is utilized in order to control the winding process of the cable ie the operation of the distribution machinery. The displacement of the guide and accordingly the pitch of the cable on the drum are hereby adjusted in accordance with the thickness measurement. For this purpose the internal width of the reel and the diameter of the cable are measured, where-after the amount of wound turns between the reel flanges is calculated, and the displacement of the guide is calculated by means of appropriate computer equipment. Also the reversal of the guide at the reel flanges is affected by the thickness measurement by calculating the amount of wound turns based on the thickness variations.

Also a coil winding machine according to this embodiment has a substantial disadvantage, namely that all these necessary computer calculations and adjusting measures caused thereby are time-consuming and result in that the reversals at the reel flanges take place too late resp. too early, particularly at high line rates, if the calculations are lagging behind.

An object of the present invention is to provide an arrangement in a coil winding machine, which avoids the above mentioned disadvantages and enables adjusting of the positions of the turning points in order to automatically take into account the variations of the cable thickness. This is achieved by an arrangement according to the invention, which is characterized in that the detectors for detecting the reel flanges are arranged to be mechanically displaced each by a measuring means over a distance corresponding to the displacement of the measuring means from a determined thickness position due to deviations in the coil product thickness.

The invention is based on the idea of mechanically connecting a continuous detection of the thickness of a strandlike product, a cable, with an adjusting of the positions of the detectors, which detect the reel flanges and directly affects the reversal of the distribution machinery. In this way the detectors will be directly, without demanding calculations, adjusted by the measuring means and accordingly the positions of the turning points of the reversal will be automatically and instantly changed in accordance with the thickness variations of the cable. This results in the achievement of a tight and optimal winding of the coil even at the reel flanges quite automatically without the need of manual supervision of and intervention in the winding process.

BRIEF DESCRIPTION OF THE DRAWING FIGURES

In the following the invention will be described in more detail with reference to the attached drawing, wherein FIG. 1 is a perspective view of a coil winding machine provided with a guide for a cable, FIGS. 2 and 3 are enlarged sectional views of the guide seen in the longitudinal direction of the cable along line II—II in FIG. 3 and in section in the transverse direction along line III—III in FIG. 2 respectively, FIG. 4 is a schematic view of the operation principle of the thickness measuring means and the turning point detectors seen from above, and FIG. 5 is a perspective view of an embodiment of a rapid displacement means for the machine.

DESCRIPTION OF A PREFERRED EMBODIMENT

Figure 4:
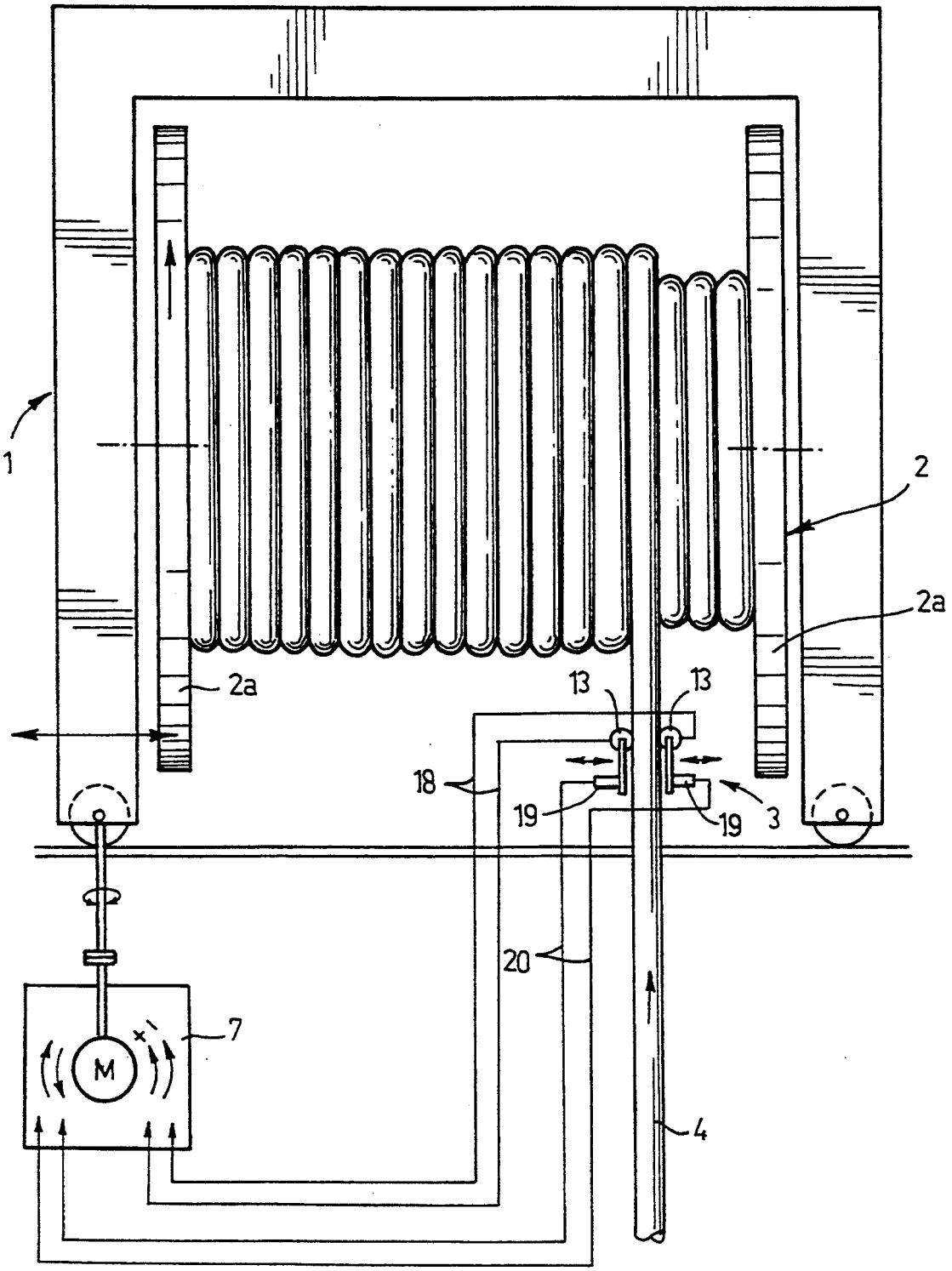

The coil winding machine shown in FIGS. 1–3 comprises as its main parts a support stand 1 for a reel 2 and a guide 3 for a cable 4 to be wound on the reel. The guide is supported by a stationary bracket 5. The support stand is, however, provided with wheels and displaceable on rails 6 by a distribution machinery, which is only schematically indicated by the reference numeral 7. By means of the distribution machinery the reel is axially displaceable forward and backward in front of the guide so that the cable is wound on the reel turn next to turn and layer upon layer between the flanges 2*a* of the reel. Such a coil winding machine is previously known and will therefore not be described in more detail in the following.

The guide 3 shown in the FIGS. 2–3 comprises a body 8, which is supported on the bracket 5 by means of a shaft 9, which is displaceable away from and towards the reel by means of a pressure fluid cylinder 10 in a manner known per se. In the body a number of V-shaped guide rollers 11 are rotatably arranged on shafts 12 extending in the transversal direction with respect to the longitudinal direction of the cable. The guide further comprises two measuring rolls 13, which are supported on opposite sides of the cable by supports 14, each slideably arranged on a rail 15, which rails are parallel to the shafts 12. A tension spring 16 is arranged between the supports in order to draw the supports towards each other. The guide further comprises a detector 17 formed by an electric slide resistance comprising two elements 17*a*, 17*b* attached to the respective supports 14. The detector is connected by a wire 18 to the distribution machinery 7, as will be described in more detail in the following. Furthermore the guide is provided with detectors 19, one for each support 14, which are mounted to detect the distance of the detectors from the reel flanges and are connected by wires 20 to the distribution machinery, as also will be described in more detail in the following. The detectors are hereby arranged in line 21 with the mantle surfaces of the measuring rolls 13 facing each other. Tilted plates 22 are arranged above the measuring rolls in order to facilitate the inserting of the cable into the guide.

The coil winding machine operates in the following way:

The cable to be wound on the reel is placed into the guide between the tilted plates so that the cable presses the supports 14 apart and falls down between the measuring rolls to be supported by the guide rollers 11. The shape of the guide rollers guarantees that the cable is automatically displaced towards the centre line of the guide by the influence of the weight of the cable and the braking force exerted on the cable.

The cable is wound on the reel due to the fact that the reel rotates and the distribution machinery simultaneously displaces the reel on its wheels in the axial direction of reel in relation to the stationary guide. The cable is wound in turns positioned adjacent to each other, and at the inside of the flanges of the reel, the axial displacement direction of the reel is reversed by means of the distribution machinery.

The reel is displaced by the distribution machinery 7 so that when the reel has rotated one turn, the reel has been displaced axially in relation to the guide over a distance corresponding to the thickness of the cable. The distribution machinery can be programmed in a known manner to calculate in advance an appropriate theoretical pitch for every cable thickness.

This pitch is continuously adjusted during the winding process by means of the described guide to better correspond to the real thickness and thickness variations of the wound cable. This adjusting is effected by the measuring rolls 13, which continuously follow the opposite longitudinal sides of the cable. As the thickness of the cable changes, the measuring rolls are displaced towards or away from each other, whereby the two elements in the slide resistance 17 are displaced in the same manner in relation to each other and send an analog electric signal corresponding to the thickness variations to the distribution machinery. The signal is received by a counter and a processor and is compared with a value corresponding to an adjusted average thickness, whereafter the processor controls the distribution machinery to correspondingly increase or decrease the axial displacement of the reel per turn, ie the pitch of the cable on the reel. The processor can be programmed to continuously calculate mean values for the width of the cable and correct the pitch of the distribution machinery either continuously or momentarily, when the thickness deviations have been accumulated above a certain value.

The detectors 19 of the guide, eg photocells, are adjusted to send a signal to the distribution machinery, when the detector is positioned at a certain distance from the corresponding flange of the reel. This value is calculated in such a manner that the detector sends its signal immediately before the cable is expected to come into contact with the flange of the reel, or at that moment when the contact takes place, so that the displacement direction of the distribution machinery is always reversed, when one layer of cable is filled between the flanges of the reel.

According to the present invention this turn-point is adjusted during the winding process by means of the guide according to the invention to better correspond to the real thickness and thickness variations of the wound cable at the flanges. This adjusting is effected in that the positions of the detectors are continuously displaced in accordance with the thickness variations of the cable, so that the detectors detect the reel flanges somewhat earlier or somewhat later than the turning point calculated according to the theoretical thickness of the cable.

FIG. 5 shows a device for rapidly drawing away the coil product from a reel flange, as the winding direction is reversed. The device comprises an elongated body 23, which in the type of machine shown in FIG. 1 is attached to the supporting bracket 5 of the guide parallel to the axis of the reel. To the body are attached two pneumatic cylinders 24 coupled in series, which are connected via rapid charging valves 25 to a pressure tank 26, which is situated close by in order to avoid pressure drop losses during the rapid actions, which are required at high line rates. The supporting shaft 9 of the guide is pivotingly mounted in the body 23 on a shaft 27, which is axially slideably mounted in the body and connected to the cylinders. By activating the respective cylinders, as the coil product contacts the reel flange, the guide is rapidly displaced sidewards by means of the shaft 27 axially away from the flange, and back to the initial position, as the winding of the coil product starts towards the other flange. The valves 25 are controlled by the operation of the detectors 19 at the flanges 2*a*. The embodiment is particularly advantageous when a coil product of a rubber type is wound, and high friction causes the proceeding coil product strand to remain at the reel flange.

The drawings and the specification in connection thereto are only intended to illustrate the idea of the invention. In its details the arrangement according to the invention may vary within the scope of the claims. Thus the invention may also be applied in a winding machine, where the support stand for the reel is stationary and the guide is displaced forward and backward by a distribution mechanism during the winding process. In its simplest embodiment the arrangement may in principle operate with only one measuring means 13, when a less exact detection of the thickness variations is acceptable. The guide can be placed upside-down so that only the braking force of the cable and not the gravity centers the cable against the guide rollers 11. The detectors 19 may instead of photocells consist of electromechanical detectors having flexible tines or directly reflecting laser transmitters/receivers. The detector 17 may consist of a linear pulse generator having an electronic counter. In order to enable manual corrections, the slide resistance may be supplemented with eg a manually adjustable additional resistance.

I claim:

1. Apparatus in a coil winding machine for winding a strandlike product on a reel provided with flanges, comprising:

a support stand for supporting the reel for rotation around an axis thereof;

a guide for supplying the strandlike product to be wound on the reel to form superimposed layers of product turns wound adjacent to each other between the flanges of the reel;

distribution machinery for displacing the support stand and the guide in relation to each other by a pitch corresponding to the thickness of the strandlike product per product turn;

detectors for detecting the reel flanges and generating a signal responsive thereto, said detectors being coupled to the distribution machinery and the machinery being responsive to said signal to cause a reversal of displacement direction between the reel and the guide as the product turn contacts a reel flange; and movable measuring means for continuously detecting the thickness of the strandlike product and for controlling the distribution machinery so that the pitch of the product turns on the reel is varied in accordance with the thickness measurement of the measuring means, said detectors being arranged for mechanical displacement in a direction parallel with the axis of the reel in response to movement of said measuring means over a distance corresponding to the displacement of the measuring means from a determined thickness position due to deviations in the strandlike product thickness.

2. Apparatus according to claim 1 wherein the measuring means are connected to control the distribution machinery so that the displacement of the reel and the guide in relation to each other is reversed in accordance with the thickness measurement of the measuring means.

3. Apparatus according to claim 1 wherein one of the detectors is arranged for each reel flange, the measuring means comprising two transversely symmetrical displaceable measuring elements on opposite sides to a path of movement of the strandlike product, the measuring elements being arranged together to adjust the positions of the detectors in relation to the reel flanges.

4. Apparatus according to claim 3 wherein the measuring elements comprise rolls mounted for rotation on parallel shafts each supported by a support slidably mounted on a shaft parallel to the axis of the reel.

5. Apparatus according to claim 4 wherein the detectors are mounted on each support for the measuring rolls.

6. Apparatus according to claim 4 wherein the guide is provided with two rotatably mounted V-shaped guide rollers positioned on opposite sides of the measuring rolls and forming a centering path of movement for the strandlike product between the measuring rolls.

7. Apparatus according to claim 3 wherein each measuring element is connected to a signal detector for producing a signal corresponding to any deviation of the measuring elements from said determined thickness position.

8. Apparatus according to claim 7 wherein the signal detector comprises a slide resistance for producing an analog voltage or current signal.

* * * * *